US006991355B1

(12) United States Patent
Coushaine et al.

(10) Patent No.: US 6,991,355 B1
(45) Date of Patent: Jan. 31, 2006

(54) LIGHT EMITTING DIODE LAMP WITH LIGHT PIPES

(75) Inventors: Charles M. Coushaine, Rindge, NH (US); Michael Tucker, Henniker, NH (US); Thomas Tessnow, Weare, NH (US)

(73) Assignee: OSRAM Sylvania Inc., Danvers, MA (US)

( * ) Notice: Subject to any disclaimer, the term of this patent is extended or adjusted under 35 U.S.C. 154(b) by 0 days.

(21) Appl. No.: 10/899,546

(22) Filed: Jul. 27, 2004

Related U.S. Application Data

(60) Provisional application No. 60/580,287, filed on Jun. 16, 2004.

(51) Int. Cl.
*F21V 7/04* (2006.01)

(52) U.S. Cl. ..... 362/555; 362/560; 362/580; 362/241; 362/252; 362/800

(58) Field of Classification Search ..... 362/241, 362/252, 554, 555, 560, 580, 581, 800
See application file for complete search history.

(56) References Cited

U.S. PATENT DOCUMENTS

| | | | | |
|---|---|---|---|---|
| 6,337,946 | B1 * | 1/2002 | McGaffigan | 362/555 |
| 6,527,412 | B2 * | 3/2003 | Ko | 362/252 |
| 2004/0012959 | A1 * | 1/2004 | Robertson et al. | 362/555 |

* cited by examiner

*Primary Examiner*—Stephen F Husar
(74) *Attorney, Agent, or Firm*—William E. Meyer

(57) ABSTRACT

An LED light source has a housing having a base. A core projects from the base; is substantially cylindrical and is surrounded by tubes. The core and the base are arrayed about a longitudinal axis. A circuit board in the base supports LEDs. Each of the LEDs is positioned with one of the tubes in a one-to-one relationship at one end of the core. A heat sink is positioned in a heat-transferring relationship with the circuit board and a first reflector is attached to another end of the core. To direct the light emitted by the LEDs from the source to the reflector, the interior of the tubes can be plated with a highly reflective material. In one embodiment, each of the tubes is fitted with a light guide, each light guide extending from a position immediately above one of the LEDs to a position adjacent the reflector.

9 Claims, 3 Drawing Sheets

LIGHT EMITTING DIODE LAMP WITH LIGHT PIPES

CROSS-REFERENCE TO RELATED APPLICATIONS

This application claims priority from Provisional Patent Appln. Ser. No. 60/580,287, filed Jun. 16, 2004.

TECHNICAL FIELD

This invention relates to light sources and more particularly to light sources employing light emitting diodes (LED or LEDs) and more particularly to light sources useful in the automotive field such as for headlights, taillights, stoplights, fog lights, turn signals, etc. Still more particularly, it relates to such light sources packaged to achieve industry accepted interchangeability.

BACKGROUND ART

In the past, most automotive light sources have involved the use of incandescent bulbs. While working well and being inexpensive, these bulbs have a relatively short life and, of course, the thin filament employed was always subject to breakage due to vibration.

Recently some of the uses, particularly the stoplight, have been replaced by LEDs. These solid-state light sources have incredible life times, in the area of 100,000 hours, and are not as subject to vibration failures. However, these LED sources have been hard-wired into their appropriate location, which increases the cost of installation. It would therefore be an advance in the art if an LED light source could be provided that had the ease of installation of the incandescent light sources. It would be a still further advance in the art if an LED light source could be provided that achieved an industry accepted interchangeable standard to replace the aforementioned incandescent bulb.

DISCLOSURE OF INVENTION

It is, therefore, an object of the invention to obviate the disadvantages of the prior art.

It is another object of the invention to enhance LED light sources.

Yet another object of the invention is the provision of an LED light source having good heat dissipation.

These objects are accomplished, in one aspect of the invention, by the provision of an LED light source comprising a housing having a base with a hollow core projecting from the base, the hollow core being substantially cylindrical and being surrounded by a plurality of elongated hollow tubes. The hollow core and the base are arrayed about a longitudinal axis 19. A printed circuit board is positioned in the base and has a plurality of LEDs operatively fixed thereto, each of the plurality of LEDs being positioned with one of the elongated hollow tubes in a one-to-one relationship at one end of the hollow core. A heat sink is positioned in a heat-transferring relationship with the printed circuit board, and a first reflector is attached to another, opposite end of the hollow core.

Elimination of a former metal post that was necessary to carry the heat away from LEDs that were mounted to emit light directly at a reflector from a remote position greatly simplifies construction and reduces cost. Further, mounting the LEDs on a printed circuit board that is in direct contact with a heat sink removes heat more effectively. Additionally, the heat sink is mounted outside of the reflector, again aiding in the removal of heat from the entire lamp.

BRIEF DESCRIPTION OF THE DRAWINGS

FIG. 3 an enlarged sectional view of the light guides of the invention; and

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
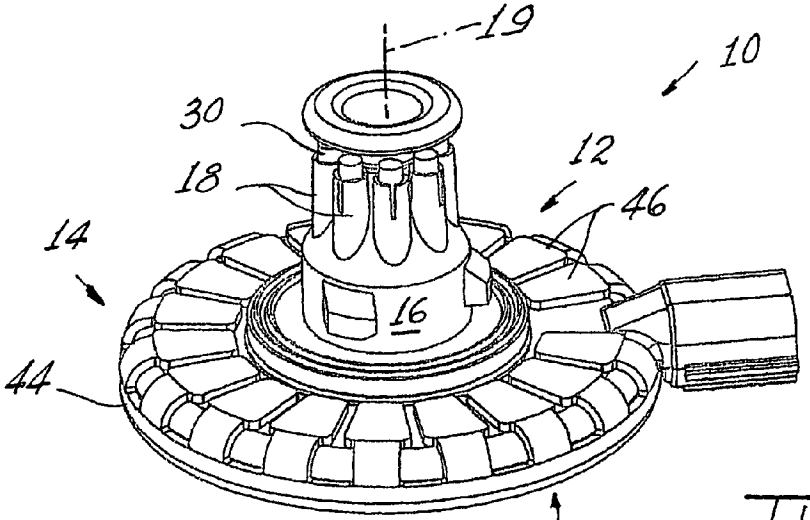
FIG. 1 is a perspective view of an embodiment of the invention.
Figure 2:
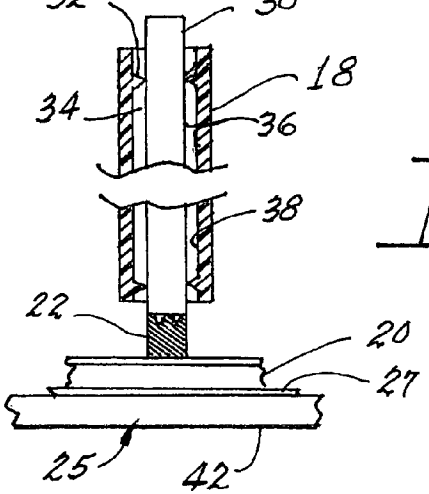
FIG. 2 is an elevational sectional view of the embodiment of the invention of FIG. 1.
Figure 2:
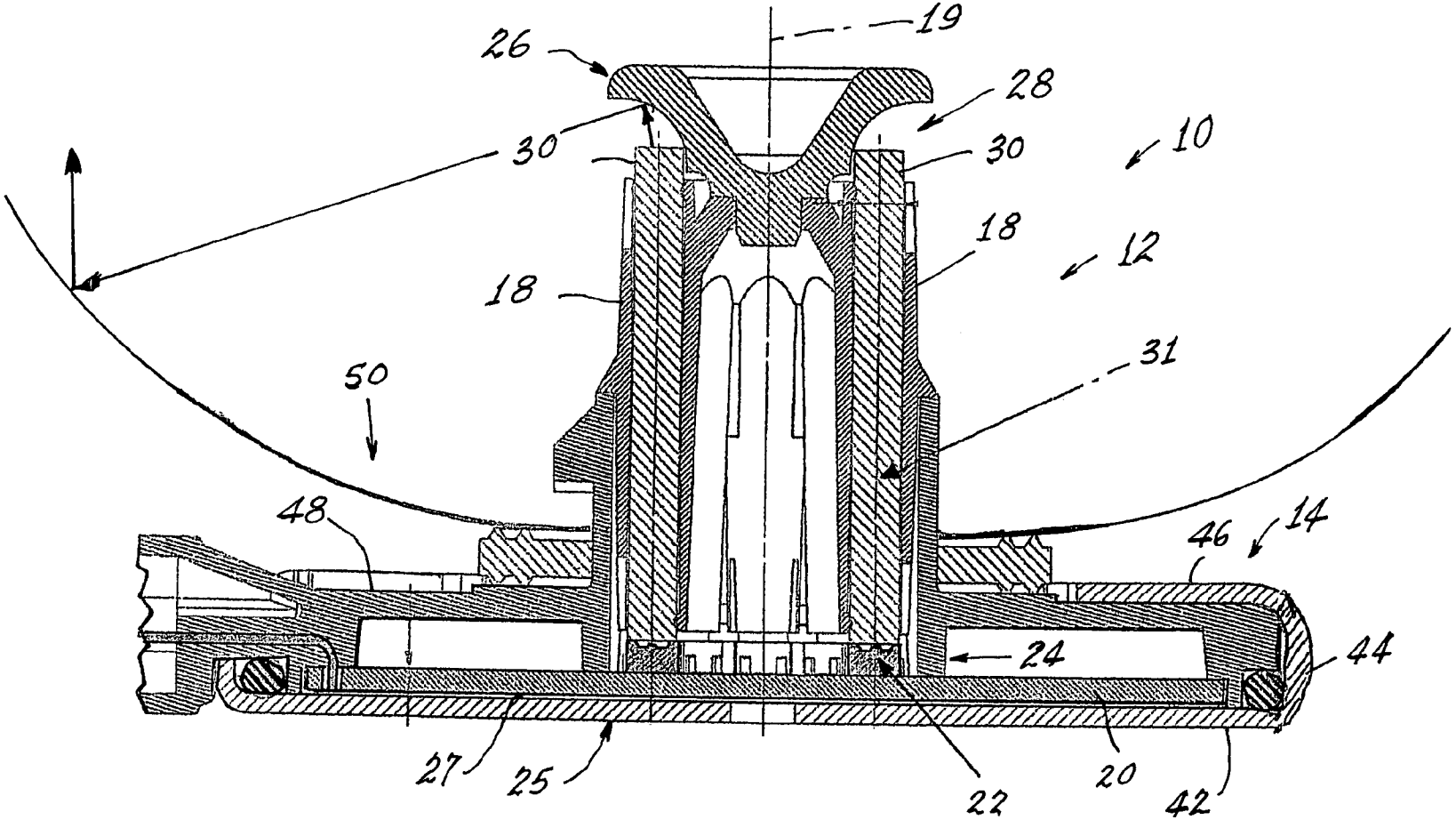

Referring now to the drawings with greater particularity, there is shown in FIG. 1 an LED light source 10 comprising a housing 12 having a base 14. A hollow core 16 projects from the base 14 and is substantially cylindrical and is surrounded by a plurality of elongated hollow tubes 18. The hollow core 16 and the base 14 are arrayed about a longitudinal axis 19. In a preferred embodiment of the invention there are eight tubes 18; however, the actual number of tubes will be dependent upon the light output of the individual LEDs and, as this light output increases, the number of tubes can be reduced. A printed circuit board 20 (see FIG. 2) is positioned in the base 14 and has a plurality of LEDs 22 operatively fixed thereto. Each of the plurality of LEDs 22 is positioned with one of the elongated hollow tubes 18 in a one-to-one relationship at one end 24 of the hollow core 16. A heat sink 25 is positioned in a heat-transferring relationship with the printed circuit board and a first reflector 26 is attached to another end 28 of the hollow core 16.

To direct the light emitted by the LEDs from the source to the reflector 26, the interior of the hollow tubes 18 can be plated with a highly reflective material. However, in a preferred embodiment of the invention each of the hollow tubes 18 is fitted with a light guide 30, each light guide 30 extending from a position in intimate contact with one of the plurality of LEDs 22 to a position adjacent the reflector 26 along a longitudinal axis 31. All surfaces of the light guides are to be a polished finish so as to transmit the maximum amount of light from the LEDs to the reflector. As noted above, and as shown more clearly in FIG. 3, the light guides are in intimate contact with the LEDs.

The light guides 30 can be any appropriate transparent material such as glass or plastic.

Also, the reflector 26 can have its surface "A" changed to greatly alter the radiated light's appearance, thus providing great flexibility to the basic bulb.

To insure that the maximum amount of emitted light is channeled through the light guides 30 each of the hollow tubes 18 is provided with inner protrusions 32 at each end for engaging the light guides 30, whereby the light guides have an air gap 34 between their outer surface 36 and the inner surface 38 of the hollow tubes 18. These features are most clearly shown in FIG. 3.

The heat sink 25 is attached to the base 14 and in thermal contact with the printed circuit board 20. Preferably thermal putty 27 such as Thermagon 304 is used to make good thermal contact between the board 20 and the heat sink 25. The heat sink 25 has a bottom 42 with an upstanding side wall 44 terminating in a plurality of fingers 46, the fingers 46 being formed to overlie an upper surface 48 of the base 14 and can be of the type shown in co-pending patent application Ser. No. 10/838,090, filed May 3, 2004 and assigned to the assignee of the present invention.

A second reflector 50 is positioned at end 24 of the hollow core 16, and has a concave curved surface 52 directed at the first reflector 26. In a preferred embodiment of the invention the concave curved surface can be parabolic. In another embodiment of the invention the reflector 26 can be eliminated and the light emanating from the LEDs could e directed to a projector optic.

Figure 4:
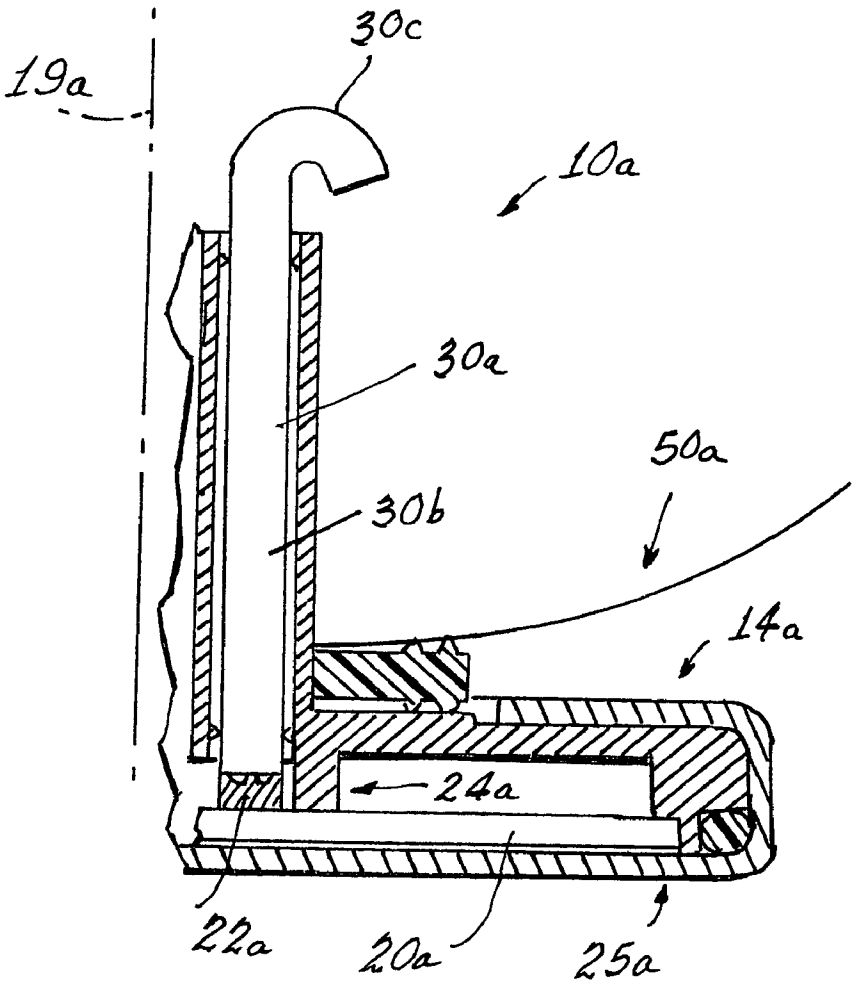
FIG. 4 is an elevational sectional view of an alternate embodiment of the invention.

An alternate embodiment of the invention is shown in FIG. 4 wherein an LED light source 10*a* contains a plurality of light guides 30*a* spaced about a longitudinal axis 19*a*, each of the light guides 30*a* having a straight portion 30*b* and a curved portion 30*c*, the curved portion extending away from the longitudinal axis 19*a*.

As with the previous embodiment, a printed circuit board 20*a* is positioned in a base 14*a* and has a plurality of LEDs 22*a* operatively fixed thereto, each of the plurality of LEDs 22 being positioned with one of the light guides 30*a* in a one-to-one relationship at one end 24*a* of the hollow core.

A heat sink 25*a* positioned in a heat-transferring relationship with said printed circuit board and a reflector 50*a* is attached to the one end 24*a* of the hollow core 16*a*. Light that emanates from the curved portions 30*c* of the light guides 30*a* is directed toward the reflector 50*a* and then outward. The embodiment eliminates the reflector 26.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An LED light source comprising:

a housing having a base;

a hollow core projecting from said base, said hollow core being substantially cylindrical and being surrounded by a plurality of elongated hollow tubes, said hollow core and said base being arrayed about a longitudinal axis;

a printed circuit board positioned in said base and having a plurality of LEDs operatively fixed thereto, each of said plurality of LEDs being positioned with one of said elongated hollow tubes in a one-to-one relationship at one end of said hollow core;

a heat sink positioned in a heat-transferring relationship with said printed circuit board; and a first reflector attached to another end of said hollow core.

2. The LED light source of claim 1 wherein each of said hollow tubes is fitted with a light guide, each light guide extending from a position immediately above one of said plurality of LEDs to a position adjacent said reflector.

3. The LED light source of claim 2 wherein each of said hollow tubes is provided with inner protrusions at each end for engaging said light guides, whereby said light guides have an air gap between their outer surface and the inner surface of said hollow tubes.

4. The LED light source of claim 3 wherein a heat sink is attached to said base and in thermal contact with said printed circuit board, said heat sink having a bottom with an upstanding side wall terminating in a plurality of fingers, said fingers being formed to overlie an upper surface of said base.

5. The LED light source of claim 4 wherein a second reflector is positioned at said one end of said hollow core, said second reflector having a curved surface directed at said first reflector.

6. The LED light source of claim 5 wherein said curved surface is parabolic.

7. An LED light source comprising:

a housing having a base;

a hollow core projecting from said base, said hollow core being substantially cylindrical and containing a plurality of light guides spaced about a longitudinal axis, each of said light guides having a straight portion and a curved portion, said curved portion extending away from said longitudinal axis;

a printed circuit board positioned in said base and having a plurality of LEDs operatively fixed thereto, each of said plurality of LEDs being positioned with one of said light guides in a one-to-one relationship at one end of said hollow core;

a heat sink positioned in a heat-transferring relationship with said printed circuit board; and a reflector attached to said one end of said hollow core, light emanating from said curved portions of said light guides being directed toward said reflector.

8. The LED light source of claim 7 wherein said reflector has a parabolic curvature.

9. An LED light source comprising:

a housing having a base;

a hollow core projecting from said base, said hollow core being substantially cylindrical and being surrounded by a plurality of elongated hollow tubes, said hollow core and said base being arrayed about a longitudinal axis;

a printed circuit board positioned in said base and having a plurality of LEDs operatively fixed thereto, each of said plurality of LEDs being positioned with one of said elongated hollow tubes in a one-to-one relationship at one end of said hollow core; and a heat sink positioned in a heat-transferring relationship with said printed circuit board.

* * * * *